US006676274B1

(12) United States Patent
Rafferty

(10) Patent No.: US 6,676,274 B1
(45) Date of Patent: Jan. 13, 2004

(54) NIGHTLIGHT WITH SUPPORT ARM

(76) Inventor: Rick A. Rafferty, 780 Summerlea Ave., Washington, PA (US) 15301

( * ) Notice: Subject to any disclaimer, the term of this patent is extended or adjusted under 35 U.S.C. 154(b) by 47 days.

(21) Appl. No.: 10/013,172

(22) Filed: Dec. 7, 2001

Related U.S. Application Data

(60) Provisional application No. 60/254,148, filed on Dec. 8, 2000.

(51) Int. Cl.[7] ..... H01R 33/00

(52) U.S. Cl. ..... 362/226; 362/276; 362/351; 362/361; 362/363; 439/148; 439/640; 439/652

(58) Field of Search ..... 362/276, 351, 362/361, 226, 363; 439/652, 651, 653, 640, 148

(56) References Cited

U.S. PATENT DOCUMENTS

| | | | | |
|---|---|---|---|---|
| 3,443,083 | A | 5/1969 | Curran | |
| 4,000,405 | A | 12/1976 | Horwinski | |
| 4,714,984 | A | 12/1987 | Spector | |
| D322,679 | S | 12/1991 | Schwartz | D26/26 |
| D323,898 | S | 2/1992 | Schwartz | D26/26 |
| D346,229 | S | 4/1994 | Ancona et al. | |
| 5,307,051 | A | 4/1994 | Sedlmayr | |
| 5,957,747 | A | 9/1999 | Liggitt | |
| D426,910 | S | 6/2000 | Hollinger | D26/125 |

*Primary Examiner*—Alan Cariaso
*Assistant Examiner*—James W Cranson, Jr.
(74) *Attorney, Agent, or Firm*—Blynn L. Shideler; Krisanne Shideler; BLK Law Group

(57) ABSTRACT

A nightlight having an outlet housing, a plurality of outlet housing prongs positioned adjacent to the outlet housing, a socket positioned adjacent to the outlet housing, the socket electrically connected to the plurality of outlet housing prongs, a bulb shade positioned adjacent to the outlet housing, the bulb shade having a width of approximately one or more inches, and a support arm removably connected to the outlet housing.

25 Claims, 10 Drawing Sheets

NIGHTLIGHT WITH SUPPORT ARM

CROSS-REFERENCE TO RELATED APPLICATION

This application claims the benefit of earlier filed United States Provisional Patent Application Serial No. 60/254,148, filed Dec. 08, 2000, entitled "Nightlight with Support Arm."

BACKGROUND OF THE INVENTION

1. Field of the Invention

The present invention relates to the field of nightlights and, more particularly, to a nightlight having a support.

2. Brief Description of the Prior Art

Nightlights are typically used to partially illuminate a room or other space, especially when natural light is not available or conventional overhead lighting is not appropriate. A nightlight usually includes an outlet housing having a first end and a second end, a set of outlet housing prongs connected to the first end of the outlet housing, a socket connected to the outlet housing and electrically connected to the set of outlet housing prongs, a bulb received in the socket, and a bulb shade which partially covers the bulb.

The set of outlet housing prongs is generally configured to be received in electrical outlet orifices defined by an electrical outlet positioned flush with a vertical surface, with the outlet housing protruding perpendicularly away from the electrical outlet and vertical surface and parallel to a floor or other surface. In this position, a gravitational force is exerted on the outlet housing. The gravitational force, defined as a product of a mass of the outlet housing and a gravity constant, acts to pull the set of outlet housing prongs out of the electrical outlet orifices. If a socket, bulb, and bulb shade are positioned on the electrical housing between a center of mass of the electrical outlet and the second end of the outlet housing, additional forces act to disengage the set of outlet housing prongs from the electrical outlet orifices.

The forces acting to pull the set of outlet housing prongs out of the electrical outlet orifices are resisted by a restoring force created by friction between the set of outlet housing prongs and the electrical outlet orifices. However, because most electrical outlet orifices are standardized to removably accept a corresponding standardized set of outlet housing prongs, increasing friction between the set of outlet housing prongs and the electrical outlet orifices is not a conventional option. Therefore, to prevent the outlet housing from drooping toward the floor or to prevent the set of outlet housing prongs from becoming disengaged from the electrical outlet orifices, most commercially available nightlights limit the size and mass of the outlet housing, socket, bulb, and the bulb shade and further position the socket, bulb, and bulb shade as close to the vertical surface and electrical outlet as possible. These design considerations help to reduce the gravitational and other forces to values which do not exceed the restoring force. However, the design considerations also limit the types of nightlights which can be produced.

SUMMARY OF THE INVENTION

To help solve the problems associated with the prior art, the present invention includes a nightlight generally having an outlet housing, a plurality of outlet housing prongs positioned adjacent to the outlet housing, a socket positioned adjacent to the outlet housing, the socket electrically connected to the plurality of outlet housing prongs, and a bulb shade positioned adjacent to the outlet housing, the bulb shade having a width of approximately one or more inches.

The outlet housing may define a plurality of prong receiving orifices each electrically connected to the plurality of outlet housing prongs and a safety cover may be provided, wherein the safety cover defines a plurality of plugs which are each individually received in a corresponding one of the plurality of prong receiving orifices.

The outlet housing may rotatable with respect to the plurality of outlet housing prongs. A photoelectric eye may be positioned adjacent to the outlet housing and electrically connected to the plurality of outlet housing prongs. The socket may further include a plurality of socket prongs, wherein each of the plurality of socket prongs are each individually received in a corresponding one of the plurality of prong receiving orifices defined by the outlet body. A bulb is preferably electrically connected to the socket, wherein the bulb is completely covered by the bulb shade. Indicia may be formed on the bulb or the bulb shade, and the bulb shade may further define heat dissipation orifices.

A nightlight according to the present invention may also include a support arm, such as a prop or cover, positioned adjacent to the outlet housing. The support arm may define a hollow storage cavity and include a plurality of support arm prongs which are positioned adjacent to the outlet housing or an electrical outlet. The support arm prongs may be electrically connected to the plurality of outlet housing prongs.

These and other advantages of the present invention will be clarified in the description of the preferred embodiment taken together with the attached drawings in which like reference numerals represent like elements throughout.

DETAILED DESCRIPTION OF THE PREFERRED EMBODIMENT

Figure 1:
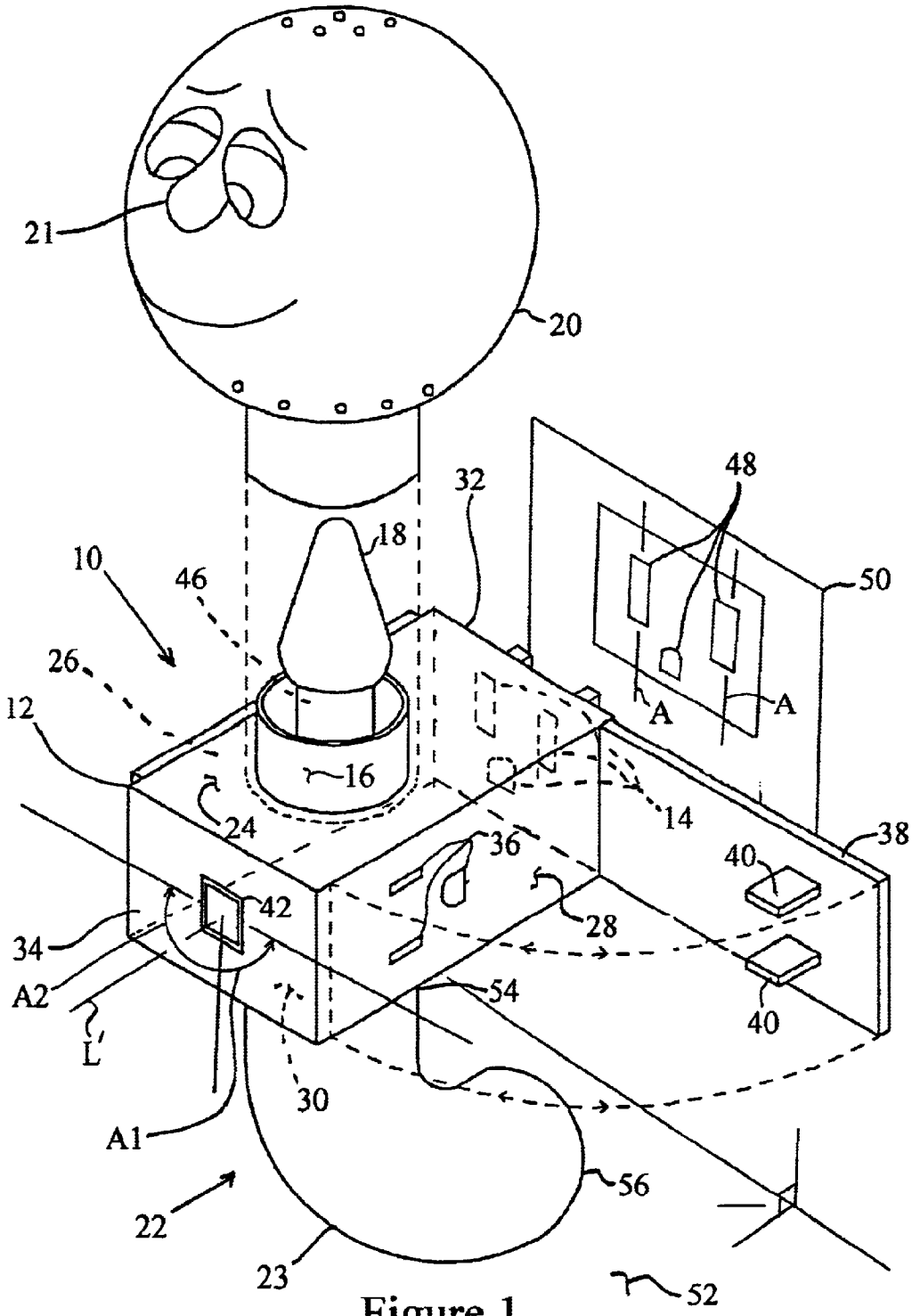
FIG. 1 is a perspective view of a nightlight according to a first embodiment of the present invention.
Figure 2:
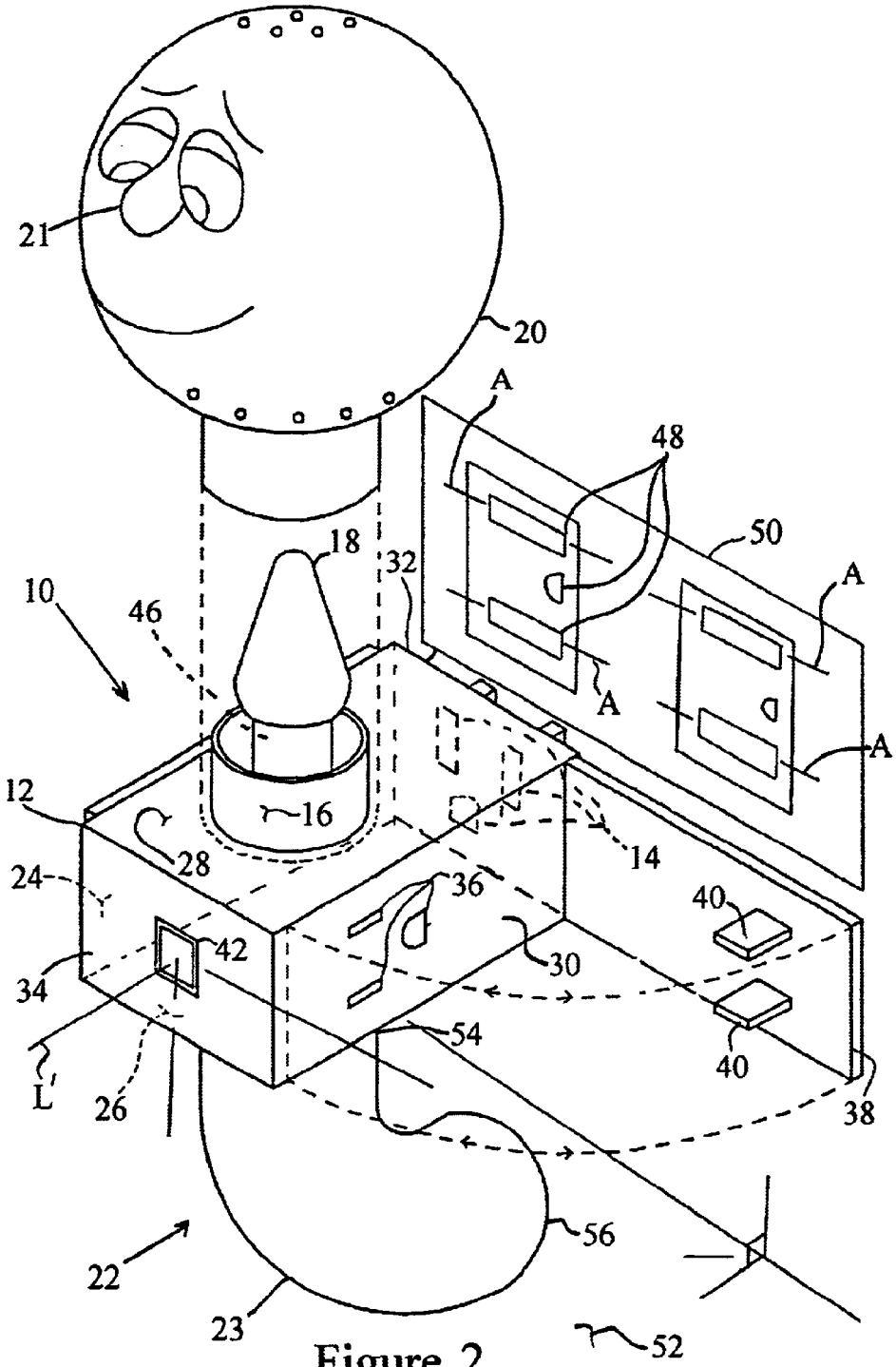
FIG. 2 is a perspective view of the nightlight shown in FIG. 1, with the outlet housing rotated ninety degrees.
Figure 3:
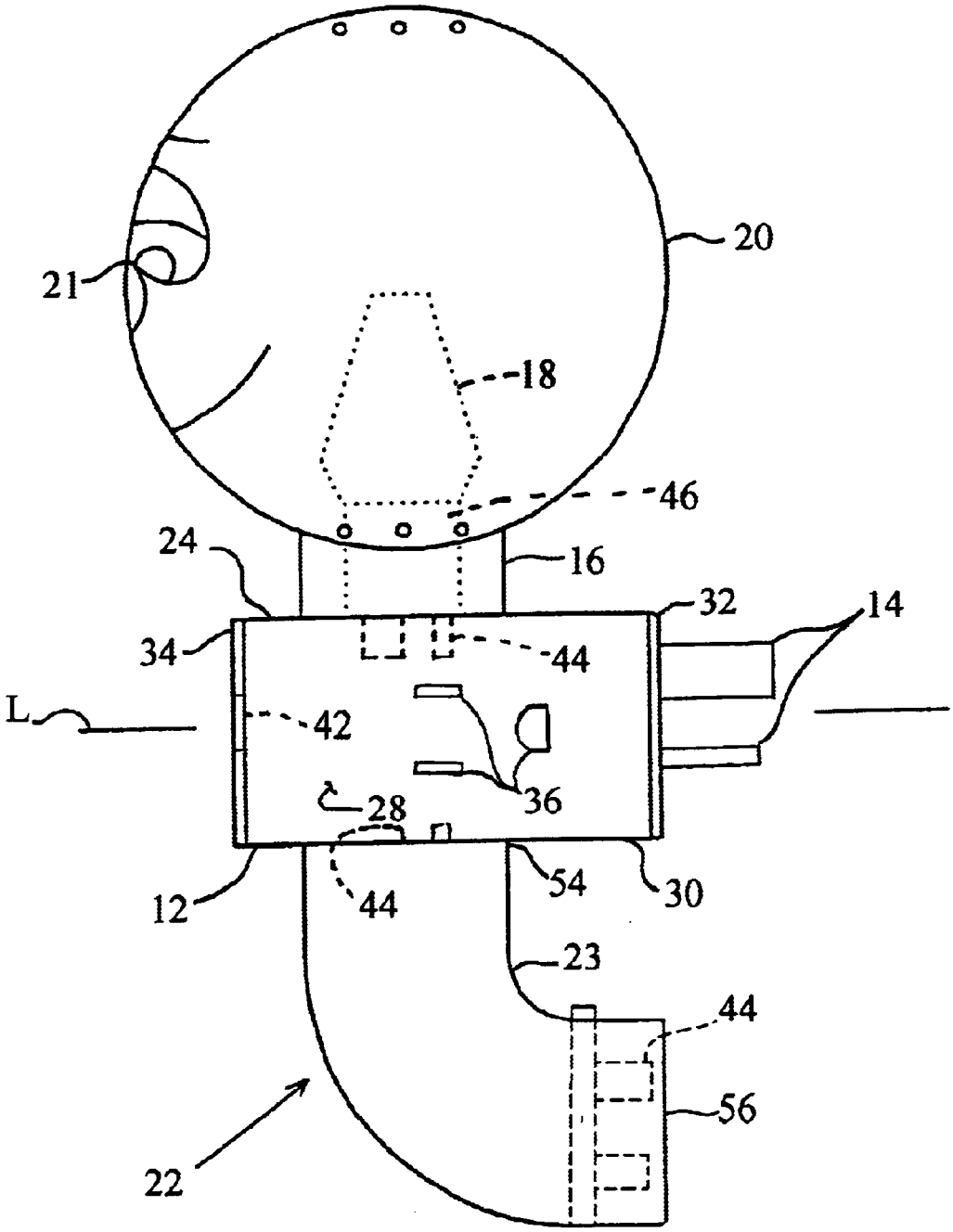
FIG. 3 is a side view of the nightlight shown in FIG. 1.

A nightlight according to a first embodiment of the present invention is shown in FIGS. 1–3. The nightlight 10 generally includes an outlet housing 12, a plurality of outlet housing prongs 14, a socket 16, a bulb 18, a bulb shade 20, and a support arm 22.

The outlet housing 12 is generally a box-like structure, preferably made from plastic or other suitable material, but other suitable geometric shaped structures are also acceptable. The outlet housing 12 may include a first side 24, a second side 26, a third side 28, a fourth side 30, a first end 32, and a second end 34. The first, second, third, and fourth sides 24, 26, 28, 30 of the outlet housing 12 generally each define a plurality of prong receiving orifices 36 which may be covered with removable safety covers 38 forming a plurality of plugs 40. The safety covers 38 and plugs 40 are preferably made from plastic or other suitable material, with each of the plurality of plugs 40 configured to be individually received in a corresponding one of the plurality of prong receiving orifices 36. Each one of the plurality of prong receiving orifices 36 is electrically connected, preferably with electrically conductive insulated wire or other suitable material, to the plurality of outlet housing prongs 14 shown in detail in FIG. 3. The plurality of outlet housing prongs 14 may be arranged in a two-prong, two-prong safety, or three-prong grounded configuration. The outlet housing may further include a photoelectric eye 42, shown in FIGS. 1–3, electrically connected to the plurality of outlet housing prongs 14, the socket 16, and each one of the plurality of prong receiving orifices 36.

As shown in FIG. 3, the socket 16 preferably has a plurality of socket prongs 44 and defines a bulb receiving orifice 46. The plurality of socket prongs 44 are generally individually removably received in a corresponding one of the plurality of prong receiving orifices 36 defined by the outlet housing 12. Alternatively, the socket 16 may be integrally connected to the outlet housing 12. The advantage of having the socket 16 removably connected to the outlet housing 12 is best shown in FIGS. 1 and 2. The outlet housing 12 can be rotated 90 degrees about a longitudinal axis of the outlet housing 12, as indicated by the arrows Al, A2 in FIG. 1, depending on the orientation of electrical outlet orifices 48 defined by an electrical outlet 50. For example, FIG. 1 shows the outlet housing 12, with the plurality of outlet housing prongs 14 positioned to engage electrical outlet orifices 48 each having an axis A oriented substantially perpendicular to a floor 52 or other surface. FIG. 2 shows the outlet housing shown in FIG. 1 rotated 90 degrees in the A1 direction so that the outlet housing prongs 14 are positioned to engage the electrical outlet orifices 48 each having an axis A' oriented substantially parallel to the floor 52 or other surface. In this first embodiment, if the socket 16 were not removably connected to the outlet housing 12, rotation of the outlet housing 12 from the orientation shown in FIG. 1 to the orientation shown in FIG. 2 would position the socket 16 parallel to the floor 52.

Referring again to FIGS. 1–3, the bulb 18 is received in a bulb receiving orifice 46 defined by the socket 16. The bulb 18 may be uncovered, partially covered, or completely covered by a bulb shade 20, generally having an outer dimension greater than one inch. In any case, indicia 21 may be formed on the bulb 18, formed on the bulb shade 20, or defined by the bulb shade 20.

As shown in FIGS. 1–3, the support arm 22 is a prop 23, with the prop 23 having a first support end 54 and a second support end 56. The prop 23 is also preferably removably connected to the outlet housing 12 for the same reasons discussed in connection with the socket 16. The first support end 54 of the prop 23 may be positioned adjacent to the outlet housing 12 and the second support end 56 may be positioned adjacent to the electrical outlet 50 or another vertical surface. The prop 23 may be a solid or hollow object, preferably made from plastic or other suitable material, with a hollow configuration being preferred. A hollow prop 23 may be configured to cover a second socket positioned opposite to the socket 16 shown in FIGS. 1–3, or house an aromatic substance such as potpourri or scented oils, items which are desired to be easily accessed in emergency situations, a retractable set of plugs, a second plurality of outlet housing prongs oriented to be received in a corresponding plurality of electrical outlet orifices 48, or any other aesthetic or utilitarian items. An access door may be included in the prop 23, if desired. One function of the support arm 22, such as the prop 23, is to counteract forces exerted on the outlet housing 12 when the outlet housing 12 is inserted in the electrical outlet 50, so that the outlet housing 12, socket 16, bulb 18, and bulb shade 20 can each have a larger mass and the socket 16, bulb 18, and bulb shade 20 can be positioned adjacent to the second end 34 of the outlet housing 12 without the nightlight 10 drooping toward the floor 52 or falling out of the electrical outlet 50.

Figure 4:
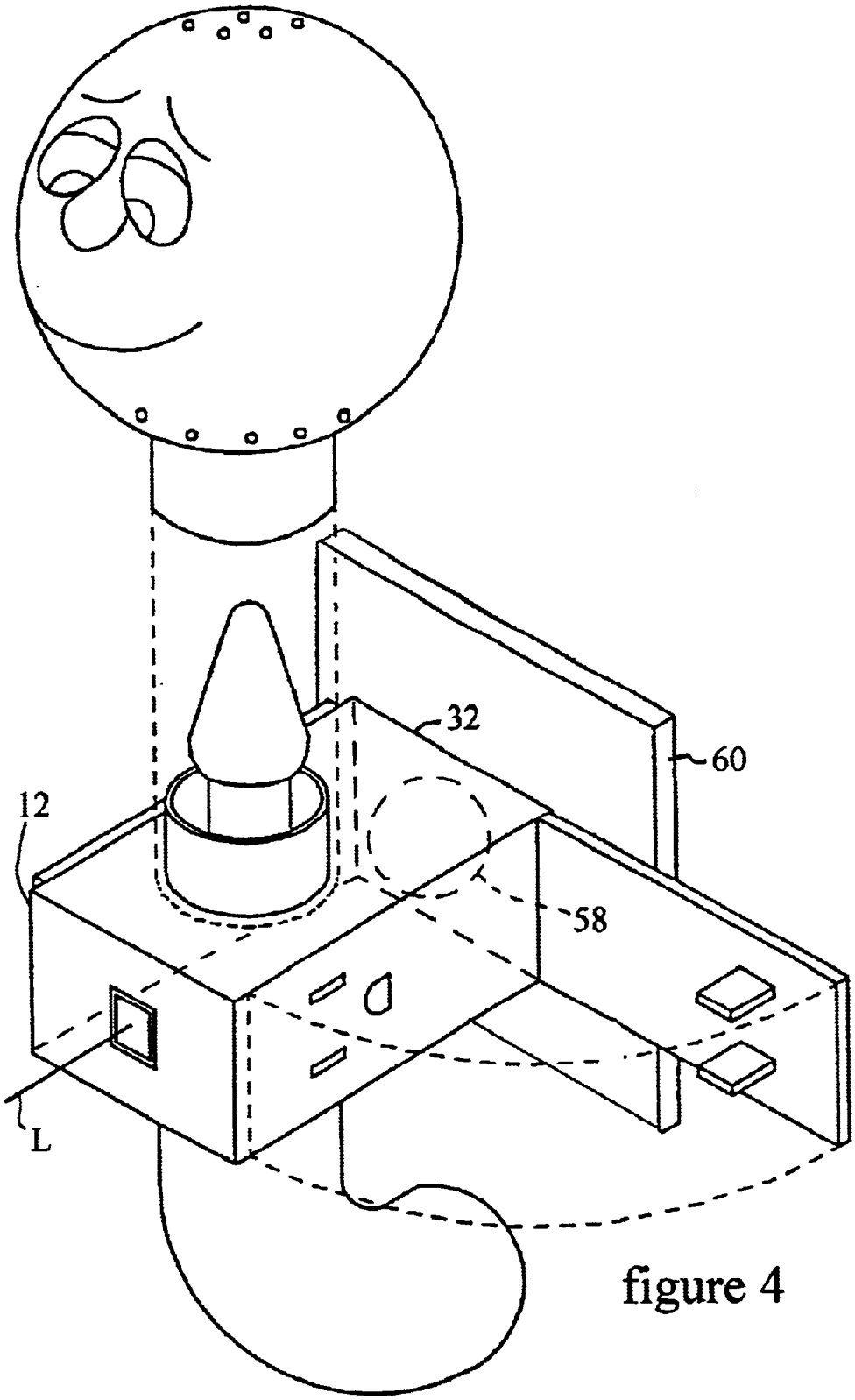
FIG. 4 is a perspective view of a nightlight according to a second embodiment of the present invention.
Figure 5:
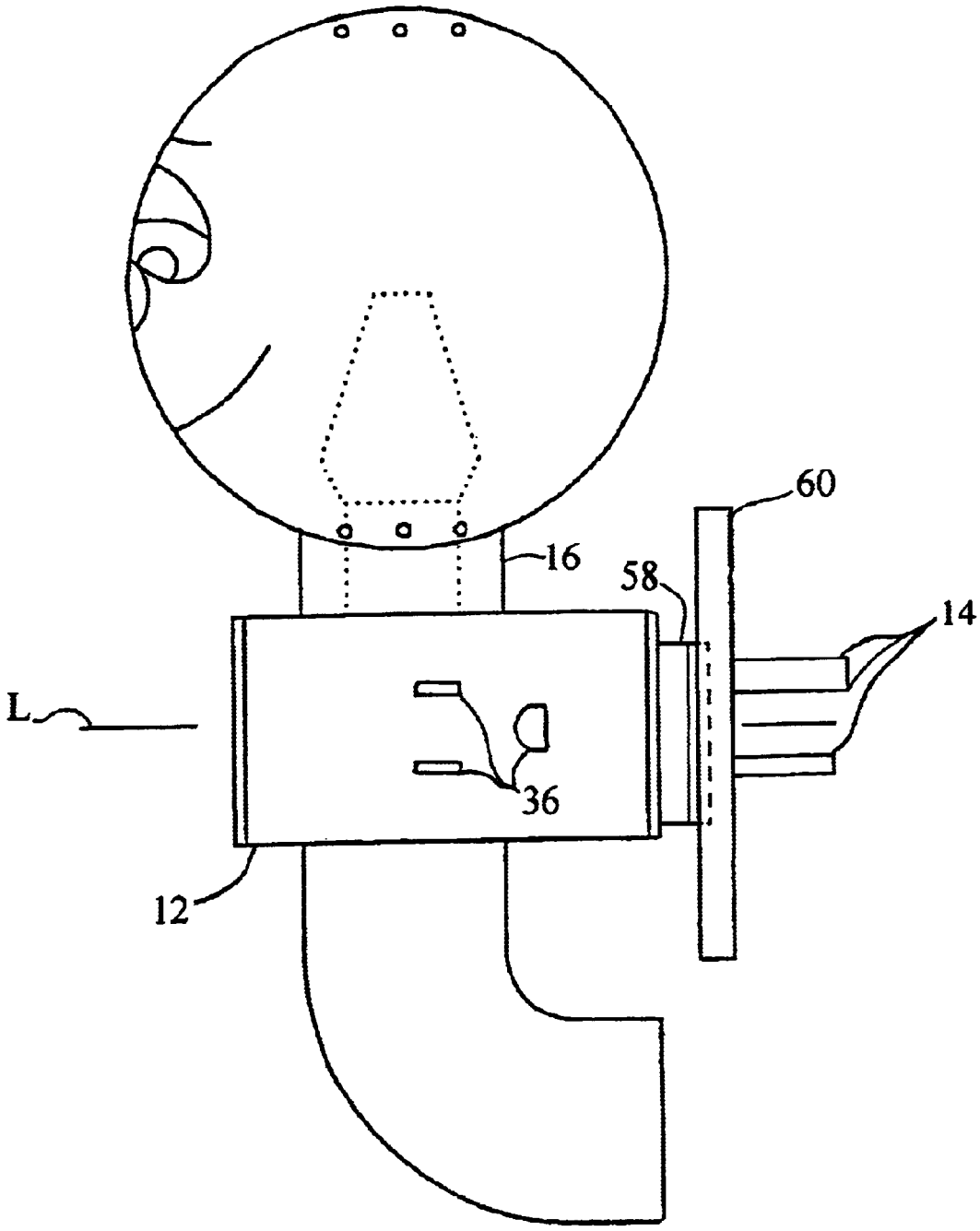
FIG. 5 is a side view of the nightlight shown in FIG. 4.

A second embodiment of the present invention is shown in FIGS. 4 and 5. The second embodiment is similar to the first embodiment shown in FIGS. 1–3, with like reference numerals indicating like parts. However, the second embodiment further includes a rotatable joint 58 connected to the first end 32 of the outlet housing 12 and a base 60 connected to the rotatable joint 58. The rotatable joint 58 rotates 360 degrees, and allows the base 60 to be rotated about the longitudinal axis L of the outlet housing 12. The plurality of outlet housing prongs 14 is positioned adjacent to the base 60 and is in electrical connection with the outlet housing 12, the socket 16, the prong receiving orifices 36, or any other device requiring power.

Figure 6:
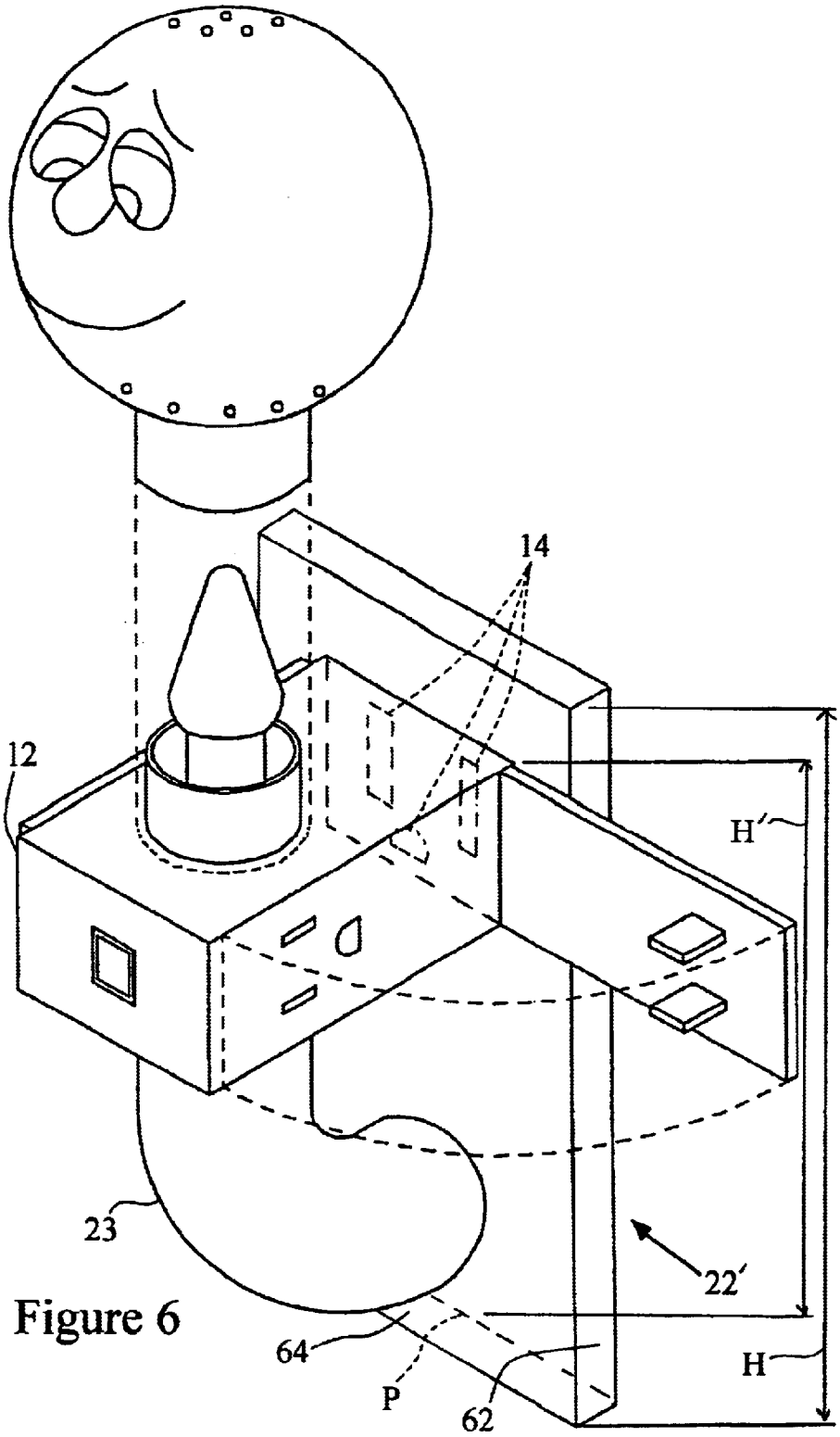
FIG. 6 is a perspective view of a nightlight according to a third embodiment of the present invention.
Figure 7:
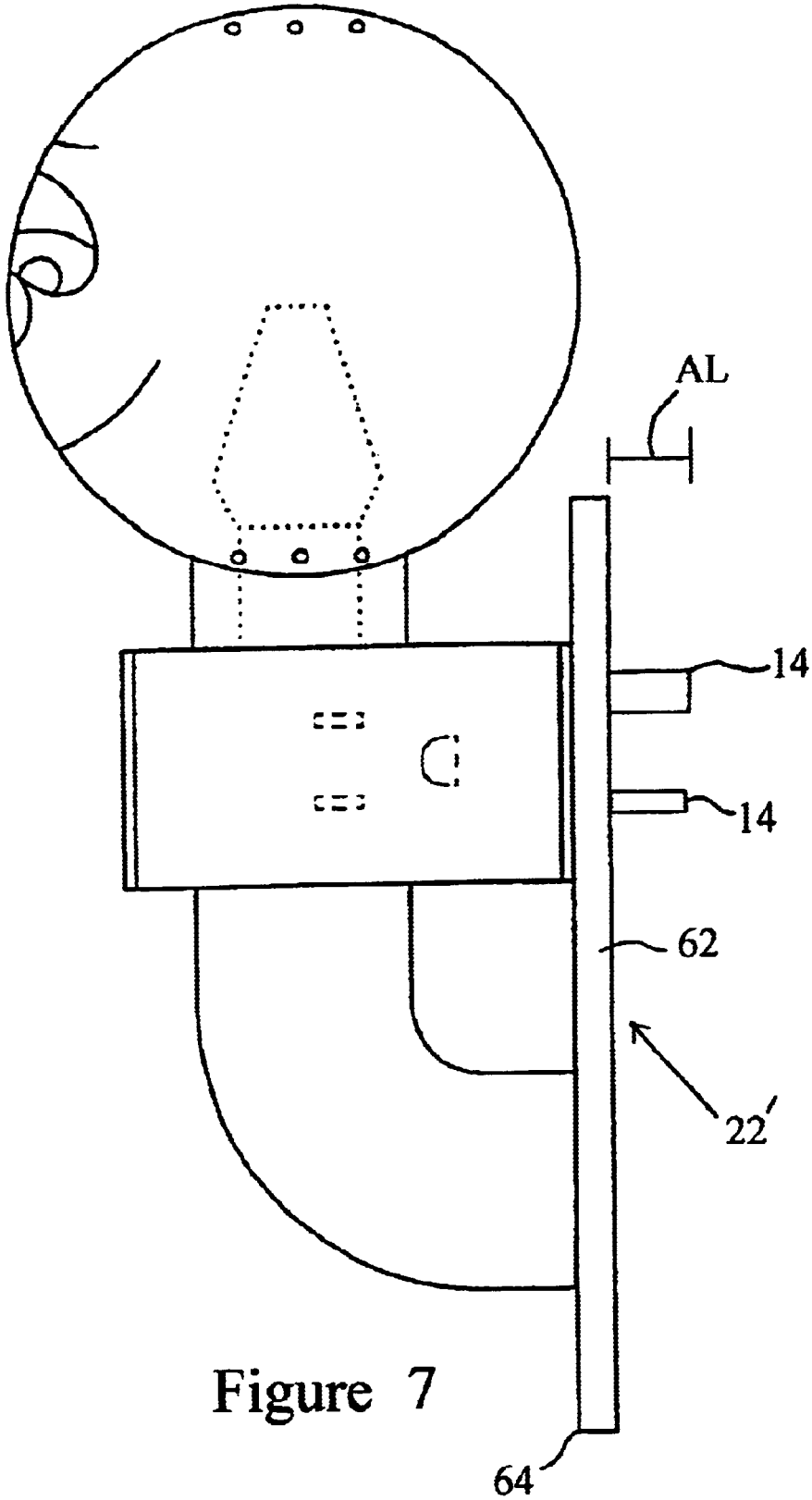
FIG. 7 is a side view of the nightlight shown in FIG. 6.

A third embodiment of the present invention is shown in FIGS. 6–7. The third embodiment is similar to the first embodiment shown in FIGS. 1–3, with like reference numerals indicating like parts. However, in the third embodiment, the support arm 22' is a cover 62 having a height H which exceeds a height H' of the outlet housing 12 and the prop 23. Increasing the height H of the cover 62 moves a pivot joint P created at a first cover end 64 of the cover 62 in a direction away from the outlet housing prongs 14. In this embodiment, the prop 23 does not necessarily function to support the outlet housing 12, but may be included to provide a space for the inclusion of additional items.

Figure 8:
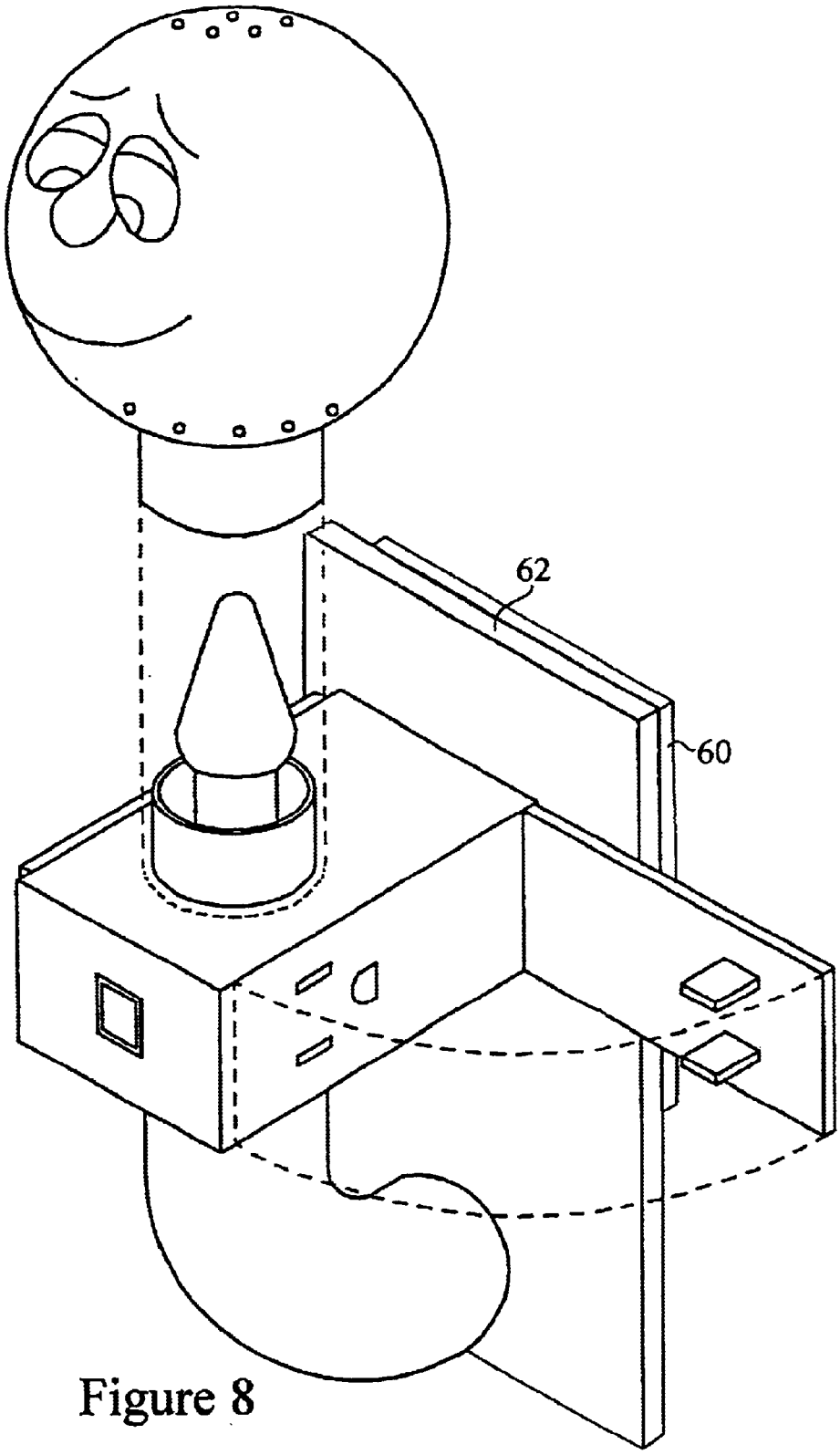
FIG. 8 is a front perspective view of a nightlight according to a fourth embodiment of the present invention.
Figure 9:
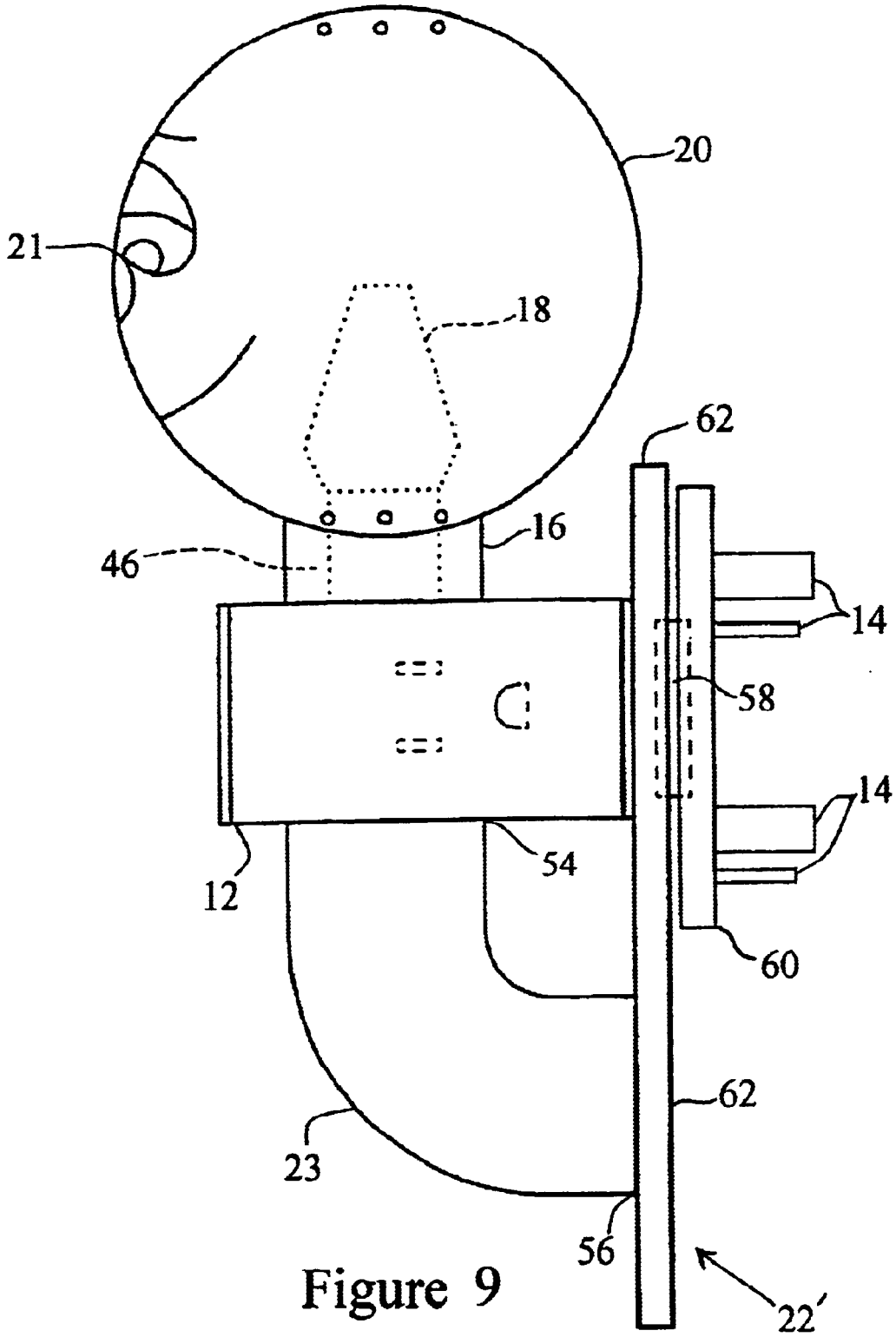
FIG. 9 is a side view of the nightlight shown in FIG. 8.
Figure 10:
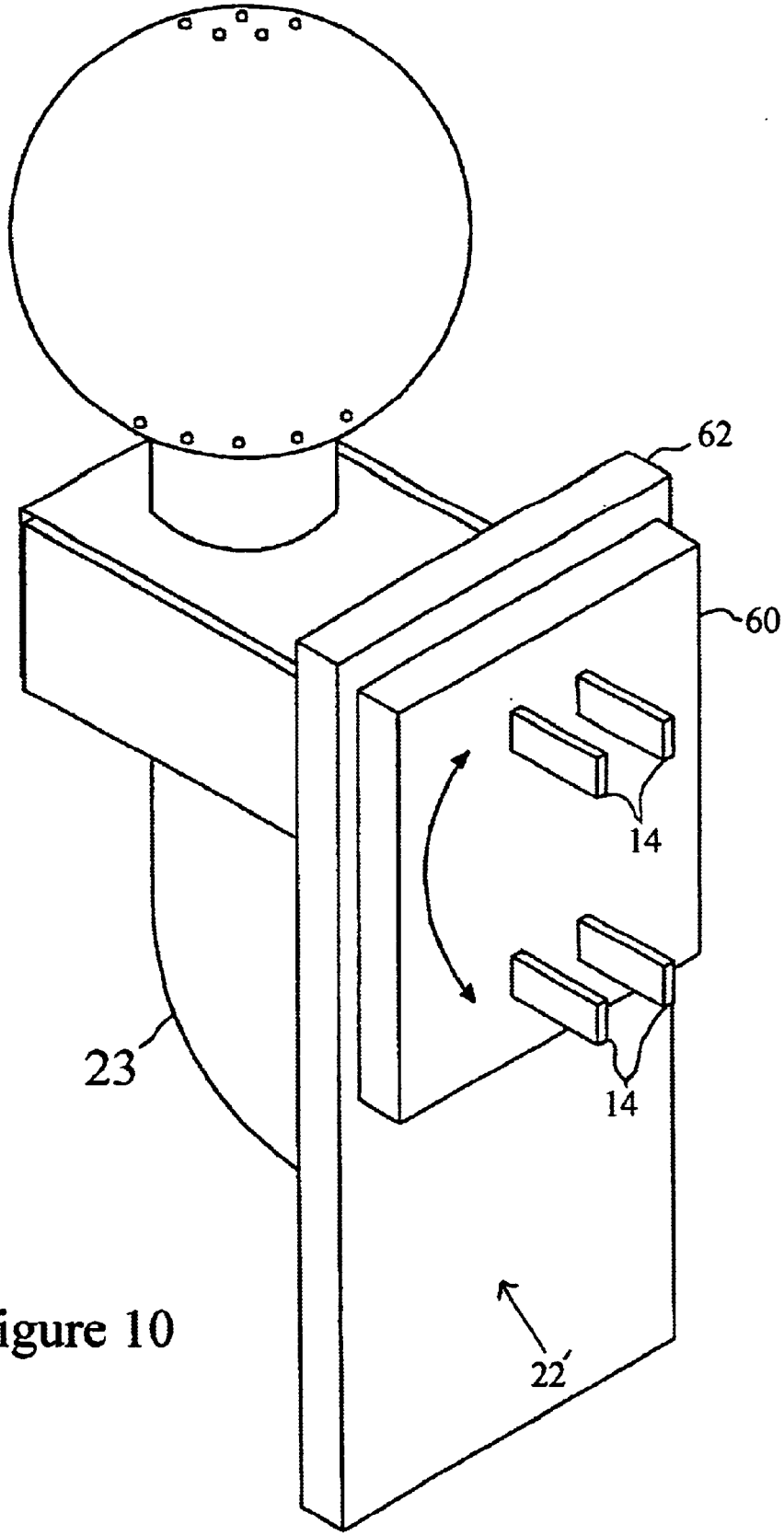
FIG. 10 is a rear perspective view of the nightlight shown in FIGS. 8 and 9.

A fourth embodiment of the present invention is shown in FIGS. 8–10. The fourth embodiment is similar to the second and third embodiments shown in FIGS. 4–7, with like reference numerals indicating like parts. However, the fourth embodiment includes the cover 62 positioned between the outlet housing 12 and the base 60.

As described above, the present invention provides a nightlight having a support, such as a prop, cover, or other suitable device. One purpose of the support is to allow the nightlight bulb shade to have an increased size and mass. Another purpose of the support is to allow for the use of sockets and bulbs having increased size and mass. Yet another purpose of the support is to provide storage for items.

The invention has been described with reference to the preferred embodiment. Obvious modifications and alterations will occur to others upon reading and understanding the preceding Detailed Description and the drawings referenced therein. It is intended that the invention be construed as including all such modifications and alterations insofar as they come thin the scope of the appended claims or the equivalents thereof.

I claim:

1. A nightlight comprising:

an outlet housing that extends along an imaginary longitudinal axis and defines an outer surface;

a plurality of outlet housing prongs positioned adjacent to the outlet housing;

a socket positioned adjacent to the outer surface of the outlet housing, oriented orthogonally with respect to the imaginary longitudinal axis of the outlet housing, and electrically connected to the plurality of outlet housing prongs; and a bulb shade positioned adjacent to the socket and the outlet housing, wherein the bulb shade defines a hollow sphere, substantially encompasses the socket, and is positioned orthogonally with respect to the imaginary longitudinal axis of the outlet housing.

2. The nightlight as claimed in claim 1, wherein the outlet housing defines a plurality of prong receiving orifices each electrically connected to the plurality of outlet housing prongs.

3. The nightlight as claimed in claim 2, further comprising a safety cover defining a plurality of plugs, wherein the plurality of plugs are each individually received in a corresponding one of the plurality of prong receiving orifices.

4. The nightlight as claimed in claim 1, wherein the outlet housing is rotatable with respect to the plurality of outlet housing prongs.

5. The nightlight as claimed in claim 1, further comprising a photoelectric eye positioned adjacent to the outlet housing, the photoelectric eye electrically connected to the plurality of outlet housing prongs.

6. The nightlight as claimed in claim 1, wherein the socket further comprises a plurality of socket prongs, wherein each of the plurality of socket prongs are each individually received in a corresponding one of the plurality of prong receiving orifices defined by the outlet body.

7. The nightlight as claimed in claim 1, further comprising a bulb electrically connected to the socket.

8. The nightlight as claimed in claim 7, wherein the bulb is completely covered by the bulb shade.

9. The nightlight as claimed in claim 1, wherein the bulb shade defines heat dissipation orifices.

10. The nightlight as claimed in claim 1, further comprising indicia formed on the bulb shade.

11. The nightlight as claimed in claim 1, further comprising a support arm positioned adjacent to the outlet housing.

12. The nightlight as claimed in claim 11, wherein the support arm defines a hollow storage cavity.

13. The nightlight as claimed in claim 11, wherein the support arm further comprises a plurality of support arm prongs positioned adjacent to the outlet housing.

14. The nightlight as claimed in claim 13, wherein the support arm prongs are electrically connected to the plurality of outlet housing prongs.

15. The nightlight as claimed in claim 11, wherein the support arm is removably connected to outlet housing.

16. A nightlight comprising:

an outlet housing that defines a plurality of prong receiving orifices;

a plurality of outlet housing prongs positioned adjacent to the outlet housing, the outlet housing prongs electrically connected to the plurality of prong receiving orifices;

a socket positioned adjacent to the outlet housing, the socket electrically connected to the plurality of outlet housing prongs; and a bulb shade positioned adjacent to the outlet housing, the bulb shade having a width of approximately one or more inches.

17. A nightlight comprising:

an outlet housing that defines a plurality of prong receiving orifices;

a plurality of outlet housing prongs positioned adjacent to the outlet housing;

a safety cover defining a plurality of plugs, wherein the plurality of plugs are each individually received in a corresponding one of the plurality of prong receiving orifices;

a socket positioned adjacent to the outlet housing, the socket electrically connected to the plurality of outlet housing prongs; and a bulb shade positioned adjacent to the outlet housing, the bulb shade having a width of approximately one or more inches.

18. A nightlight comprising:

an outlet housing that defines a plurality of prong receiving orifices;

a plurality of outlet housing prongs positioned adjacent to the outlet housing and each electrically connected to the plurality of prong receiving orifices;

a socket positioned adjacent to the outlet housing, the socket electrically connected to the plurality of outlet housing prongs and the socket further comprising a plurality of socket prongs, wherein each of the plurality of socket prongs are each individually received in a corresponding one of the plurality of prong receiving orifices defined by the outlet body;

a bulb shade positioned adjacent to the outlet housing, the bulb shade having a width of approximately one or more inches.

19. A nightlight comprising:

an outlet housing;

a plurality of outlet housing prongs positioned adjacent to the outlet housing;

a socket positioned adjacent to the outlet housing, the socket electrically connected to the plurality of outlet housing prongs;

a support arm positioned adjacent to the outlet housing; and a bulb shade positioned adjacent to the outlet housing, the bulb shade having a width of approximately one or more inches.

20. The nightlight as claimed in claim 19, wherein the support arm defines a hollow storage cavity.

21. The nightlight as claimed in claim 19, wherein the support arm further comprises a plurality of support arm prongs positioned adjacent to the outlet housing.

22. The nightlight as claimed in claim 21, wherein the support arm prongs are electrically connected to the plurality of outlet housing prongs.

23. The nightlight as claimed in claim 19, wherein the support arm is removably connected to outlet housing.

24. A nightlight comprising:

an outlet housing;

a plurality of outlet housing prongs positioned adjacent to the outlet housing;

a socket positioned adjacent to the outlet housing, the socket electrically connected to the plurality of outlet housing prongs; and a bulb shade positioned adjacent to the outlet housing, the bulb shade having a width of approximately one or more inches, wherein the outlet housing is rotatable with respect to the plurality of outlet housing prongs.

25. A nightlight comprising:

an outlet housing;

a plurality of outlet housing prongs positioned adjacent to the outlet housing;

a socket positioned adjacent to the outlet housing, the socket electrically connected to the plurality of outlet housing prongs;

a bulb electrically connected to the socket, the bulb having a width of approximately one or more inches; and indicia formed on the bulb.

* * * * *